US007019656B2

(12) United States Patent
Bair, III et al.

(10) Patent No.: US 7,019,656 B2
(45) Date of Patent: Mar. 28, 2006

(54) EMPTY GAS SUPPLY TANK PENDING WARNING

(75) Inventors: Richard H. Bair, III, Weaverville, NC (US); Bryan M. Elwood, Candler, NC (US)

(73) Assignee: Kendro Laboratory Products, Inc., Asheville, NC (US)

( * ) Notice: Subject to any disclaimer, the term of this patent is extended or adjusted under 35 U.S.C. 154(b) by 21 days.

(21) Appl. No.: 10/212,095

(22) Filed: Aug. 6, 2002

(65) Prior Publication Data

US 2004/0025945 A1 Feb. 12, 2004

(51) Int. Cl.
*G08B 17/10* (2006.01)

(52) U.S. Cl. ..... 340/632; 340/618; 600/22

(58) Field of Classification Search ..... 340/632, 340/618, 500, 815.4, 384.1, 612, 614, 870.16, 340/870.01; 600/22; 435/303.1; 137/386, 137/551, 554, 557; 73/40.5, 27, 861
See application file for complete search history.

(56) References Cited

U.S. PATENT DOCUMENTS

| | | | | |
|---|---|---|---|---|
| 4,650,766 | A | 3/1987 | Harm et al. | 435/284 |
| 4,845,486 | A * | 7/1989 | Knight et al. | 340/618 |
| 4,892,830 | A | 1/1990 | Findley et al. | 435/290 |
| 5,261,276 | A * | 11/1993 | Gifford | 73/302 |
| 5,705,747 | A * | 1/1998 | Bailey | 73/290 R |
| 6,079,252 | A * | 6/2000 | Tabler et al. | 73/40 |
| 6,180,397 | B1 | 1/2001 | Binder | 435/303.1 |
| 6,265,210 | B1 | 7/2001 | Silley et al. | 435/303.1 |
| 6,437,697 | B1 * | 8/2002 | Caro | 340/618 |

* cited by examiner

*Primary Examiner*—Phung T. Nguyen
(74) *Attorney, Agent, or Firm*—Baker & Hostetler LLP

(57) ABSTRACT

An apparatus and method for notifying a user of a pending empty gas supply tank. The user can input the initial volume of the gas supply tank, a gas monitor can monitor the amount of gas that was injected into the chamber and an indicator can notify the user when the gas volume of the supply tank is at or below a predetermined level so that the user can take the appropriate action. Additionally, a gas volume converter can be included to convert from one volume unit to another.

20 Claims, 2 Drawing Sheets

EMPTY GAS SUPPLY TANK PENDING WARNING

FIELD OF THE INVENTION

Embodiments of the present invention generally relate to an apparatus and method for use with a controlled gas atmosphere. More particularly, the apparatus and method of the present invention relates to notifying a user when a gas supply tank is near empty.

BACKGROUND OF THE INVENTION

There are a number of commercial applications that utilize a controlled gas atmosphere enclosure. For example, in the semiconductor industry, gases are injected into an enclosed chamber wherein one of the gases is plasmarized and hits a target on a chamber lid causing the target's materials to deposit on a wafer. Other commercial applications include using controlled gases to cultivate biological cultures in an enclosed chamber, such as an incubator.

A conventional incubator is generally rectangular in shape and has up to five insulated walls (top, bottom, left side, right side, and rear). Each wall may have an inner space defined by the inner and outer surfaces of the insulated wall and the inner spaces can be in communication with each other. An insulated front door together with the insulated walls complete the inner chamber of the incubator and the door is typically mounted on hinges on the front side of one of the side walls. The door allows access into the inner chamber where culture plates are placed or removed from the shelves that are provided therein.

It is desirable to maintain optimal conditions inside the incubator in order to promote the desired growth of the cultures and to document the experiment for repeatability by others. In a conventional incubator, gases such as $O_2$, $N_2$, and $CO_2$ are introduced from their respective primary supply tanks into the chamber depending on the growing conditions desired. Additionally, some incubators can also have a secondary or backup tank in addition to the primary supply tank and both supply tanks are controlled by an incubator tank switcher system. The incubator tank switching system can be manually or automatically set to switch from the primary to the secondary supply tank when the primary tank is low on gas or has other problems. Typically, the user sets the $CO_2$ and $O_2$ setpoints and the appropriate gases are added. $N_2$ can be used to purge excess $O_2$ from the incubator when the $O_2$ level in the chamber is too high for the setpoints.

In some experiments, maintaining a certain gas concentration in the chamber is critical to the experiment's success. For example, in some experiments it can be important to maintain $CO_2$ at 5% throughout the experiment either to confirm a hypothesis or to document the process for repeatability. Various parameters can affect the $CO_2$ concentration (and other gases, such as $O_2$), such as the escape of the gas when the incubator door is open, and high humidity levels in the incubator. Another parameter that can affect the $CO_2$ concentration is the pressure and the volume of the $CO_2$ gas supply tank being too low or empty.

Conventionally, in order to ensure that the $CO_2$ level is maintained in the incubator, the user can monitor the incubator tank switcher system or monitor the gas level (gauge) of the supply tank to see if it is near empty. However, these preventive measures may not work when the user forgets to check the volume level or the gauge on a constant basis. Additionally, conventional incubators can have a "tank out" warning that occurs after the supply tank is completely empty. However, this warning is not useful because corrective measures may not be effective by the time the user is notified and a new tank is connected or switched. Additionally, even if the primary supply tank is switched from the primary to the secondary tank automatically, the secondary tank's "tank out" warning will also occur only after the tank is empty. If the gas concentration of a gas fluctuates vastly, such as when the gas concentration is low due to the gas supply tank being empty, it can destroy the experiment and lead to the destruction of months to years worth of research. Thus, it is important to know when the gas concentration of the supply tank (primary or secondary) is near empty so that the user can be prompted to check the level of the tank and take appropriate actions.

Therefore, there is a need for a notification system to allow a user to know when the gas supply tank is about to be empty so that appropriate measures can be taken for improved culture growth.

SUMMARY OF THE INVENTION

The present invention generally relates to a notification system to allow a user to know when the gas volume of a supply tank is below a predetermined level. The notification system helps to ensure that the incubator is operating at the desired pressure for optimal growth of the cultures.

In one embodiment of the invention, a notification apparatus for an enclosed chamber includes a gas monitor that can determine the amount of gas from a gas supply tank that has been injected into the chamber, and an indicator that can notify when the gas supply tank reaches a predetermined level, wherein the monitor and the indicator are in communication with each other. The notification of apparatus further includes an interface for inputting information, and a gas volume converter that can convert from one gas volume unit to another gas volume unit, wherein the gas monitor, the indicator, the interface and the gas volume converter are in communication with each other. A user can input the initial volume of the gas supply tank via the interface. The user can input the predetermined level of gas that the user will be notified by the indicator. The gas volume unit can be cubic feet, cubic meter, cubic centimeter, cubic inch, cubic yard, milliliter, deciliter, liter, ounce, pint, quart, and gallon. Additionally, the gas monitor may be a transducer and the indicator can notify visually, audibly, tactilely or a combination thereof.

In another embodiment, a method of notifying a user of low gas supply tank volume that includes inputting an initial volume of gas of a gas supply tank, monitoring an amount of injected gas from the gas supply tank, and notifying the user when the gas supply tank reaches a predetermined level. Additionally, inputting the initial volume can be done via a user interface. The notifying method further includes inputting the predetermined level of gas that the user would be notified when the gas supply tank reaches said level. Further, monitoring the amount of injected gas is done in order to determine the remaining volume of gas in the gas supply tank. A transducer can be used to monitor and relay to an indicator when the predetermined level has been reached. Additionally, the user can be notified via visually, audibly, tactilely, or a combination thereof.

In still another embodiment, a notification system for an enclosed chamber can include a means for monitoring a gas volume that has been injected by a gas supply tank, and a means for indicating when the volume of the injected gas is at or below a predetermined level, wherein the means for monitoring and the means for indicating are in communication with each other. The notification system can further include a means for inputting information, and a means for converting from a gas volume unit to another gas volume unit. The means for inputting information can be a user interface. The gas in the gas supply tank can be selected from a group consisting of $CO_2$, $O_2$, and $N_2$. The means for monitoring the gas volume can be a transducer means. The means for indicating can notify the user visually, audibly, tactilely, or a combination thereof.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

The present invention notifies a user when the volume of a gas supply tank is about to become empty or is below a predetermined level. By notifying the user that the gas tank is at or below the predetermined volume level, the user can respond and replace the gas supply tank, thereby preventing damage to the samples in the incubator and helps to validate a hypothesis of the experiment. "Notify" as used herein can be visual, audible, tactile, or other means, so long as, the user knows when the volume of the gas supply tank is at or below the predetermined level. Notification can occur at the incubator via an integrated display or remotely, such as another display, pager, fax, email, phone, computer or any means that will allow the user to know when the volume is at or below the predetermined volume level. The transducer described herein can be located anywhere (between the hose and the inlet or embedded in the inlet) near or in the inlet, as long as it can monitor the pressure of the gas being injected at the gas inlet. The transducer can be the MPX5050GP™ from Motorola (Austin, Tex.).

Figure 1:
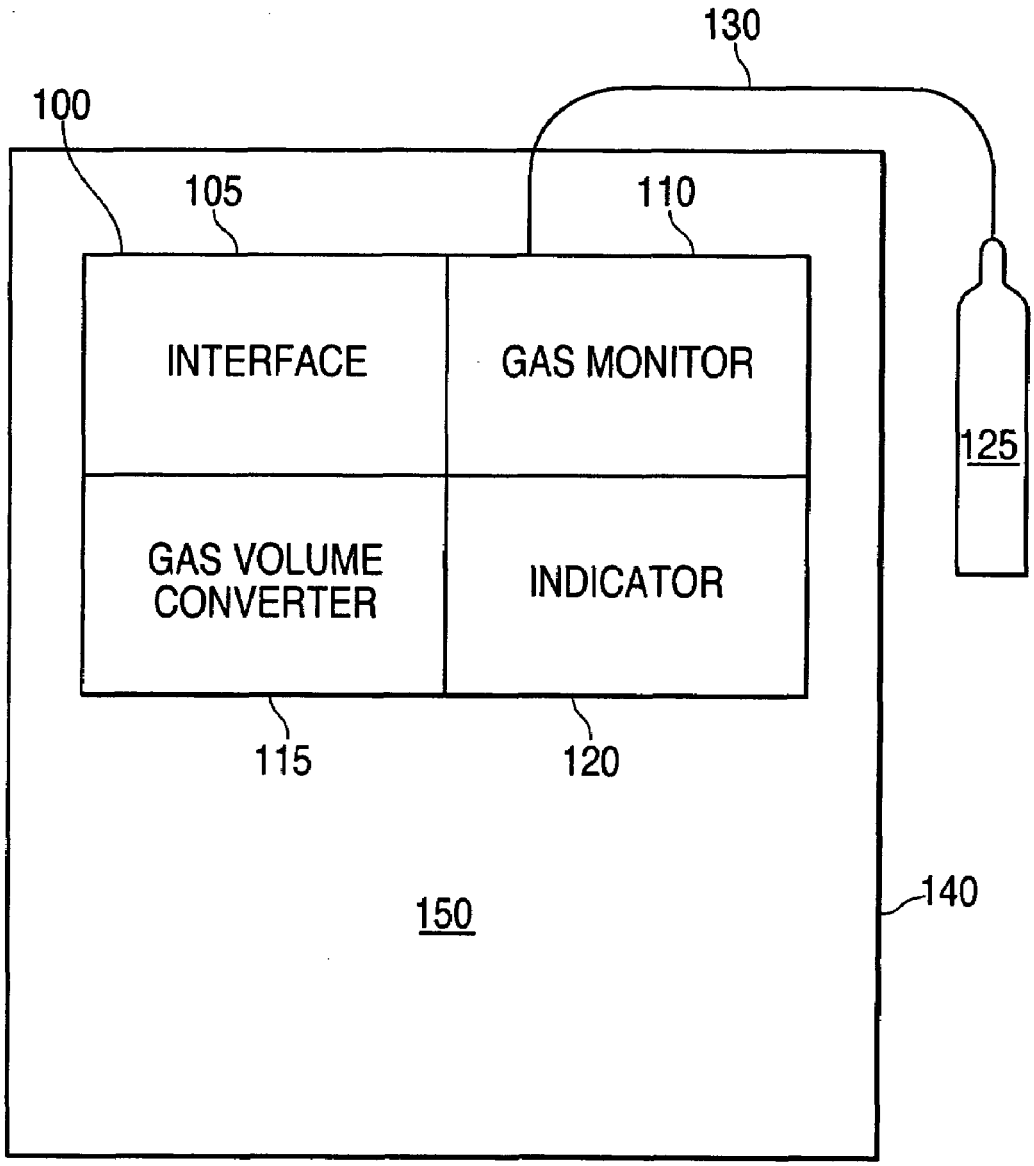
FIG. 1 is one embodiment of an apparatus of the present invention.

FIG. 1 is one embodiment of an apparatus of the present invention. A notification system 100 that can be used with any incubator 140 includes an interface 105 for inputting information, a gas monitor 110 to monitor the amount of gas being injected, a gas volume converter 115 to convert the gas volume from one unit to another unit of measurement, and an indicator 120 to indicate when the volume of the gas at or is below a predetermined level. The gas supply tank 125 provides gas to a chamber 150 of the incubator 140 via gas line 130 that is coupled to the notification system 100.

The interface 105 is provided so that information regarding the initial volume of the gas supply tank can be inputted. The conventional gas supply tanks can have 220 to 240 cubic feet of gas in them. The tanks can contain $O_2$, $CO_2$, $N_2$ or any gas that is desired. When the gas supply tank is initially hooked up to the incubator, a prompt on the indicator 120 can query the user to enter the initial volume of gas in the tank. Alternatively, the user can enter the information without being prompted or no input is required if the gas supply tank is filled to a preset volume.

The gas monitor 110 monitors the amount of gas (liters/second or other rate unit of measurement) that is being injected through an inlet that is in communication with the gas supply tank via a supply line. This is accomplished by knowing the gas types, the orifice characteristics, and pressure of the gas at the gas inlet. In a two tank back-up system, the gas monitor 110 can track the volumes of injected gas from each gas supply tank. The gas monitor 110 can include a transducer or any other device that can monitor the amount of gas being injected over a period of time. By knowing the amount of gas being injected over a period of time, the volume of the gas remaining in the gas supply tank can be determined. Once the predetermined volume of gas is reached, the gas monitor 110 can communicate with the indicator 120, which notifies the user of the pending empty gas tank.

The gas volume converter 115 can convert cubic feet to liters or from one volume unit to another, as required by the user. As stated above, the user can input the initial volume of gas in the supply tank in cubic feet. A conversion unit of 28.32 liters/cubic feet can be used to convert the volume from cubic feet to liters. For example, in a volume of 220 cubic feet (of a gas supply tank) can be multiplied by 28.32 liters/cubic feet to convert it to 6230.4 liters. Other conversion units can be used to convert from one volume unit to another. Additionally, although the gas volume converter 115 can be used, it is not required in order to practice the invention. By knowing the initial volume of the gas supply tank, the user can set a predetermined volume and be notified when the volume of the tank is at or below said level.

The indicator 120 can visually, audibly, tactilely or in any other manner notify the user when the tank volume is at or below the predetermined level. For example, the user can set the predetermined level at 5,000 liters (already injected) so that the indicator 120 can notify of the impending empty tank and this warning can be visual. Additionally, the user can be notified in increments of liters (or other unit) or set notified at a more critical level after the initial notification. For example, the user can set the indicator 120 to notify at 5900 liters, in addition to being notified at 5,000 liters, and the notification can be visual and audible in order to achieve an increased sense of urgency to the user.

Because the user can be notified before the gas supply tank is empty instead of being warned when the tank is completely empty (conventional incubators), the user can take appropriate actions, such as replacing the tank with a new tank or switch from one tank source to another. This will also relieve the user from having to monitor the secondary backup tank if the incubator is utilizing the backup tank. By taking the appropriate actions early, the samples are not damaged and the experiment data will be more accurate leading to decrease in costs and time to the user.

In another embodiment, the notification system 100 can include the user interface 105, the gas monitor 110, and the indicator 120. In this embodiment, conversion from one volume unit to another is not needed and the volume unit used can be the same as the volume unit used for the gas supply tank. The volume of the gas tank can be inputted or supplied with the user interface 105. The gas monitor 110 can be set at a predetermined volume level with the user interface 105, and the indicator 120 notifies the user when the volume of the gas supply tank is at or below the predetermined volume level.

In still another embodiment, the notification system 100 can include the gas monitor 110 and the indicator 120. The gas supply tank and the predetermined volume level can be preset at their respective levels each time so the interface 105 may not be required. Additionally, the notification system 100 can also use the predetermined volume unit so that the gas volume converter 115 may not be required. The gas monitor 110 can monitor the rate of the injected gas and notify the user via the indicator 120.

In still a further embodiment, the notification system 100 can include the gas monitor 110, the gas volume converter 115, and the indicator 120. The gas supply tank's initial volume and the predetermined volume level can be preset at their respective levels each time so that the interface 105 may not be required. The gas monitor 110 can monitor the rate of gas that is injected over a period of time in order to determine when the volume of the gas supply tank is at or below the predetermined level. Additionally, the gas volume converter 115 can be used to convert from one volume unit to another that is desired by the user. The indicator 120 can notify the user when the gas supply tank is at or below the predetermined level.

Figure 2:
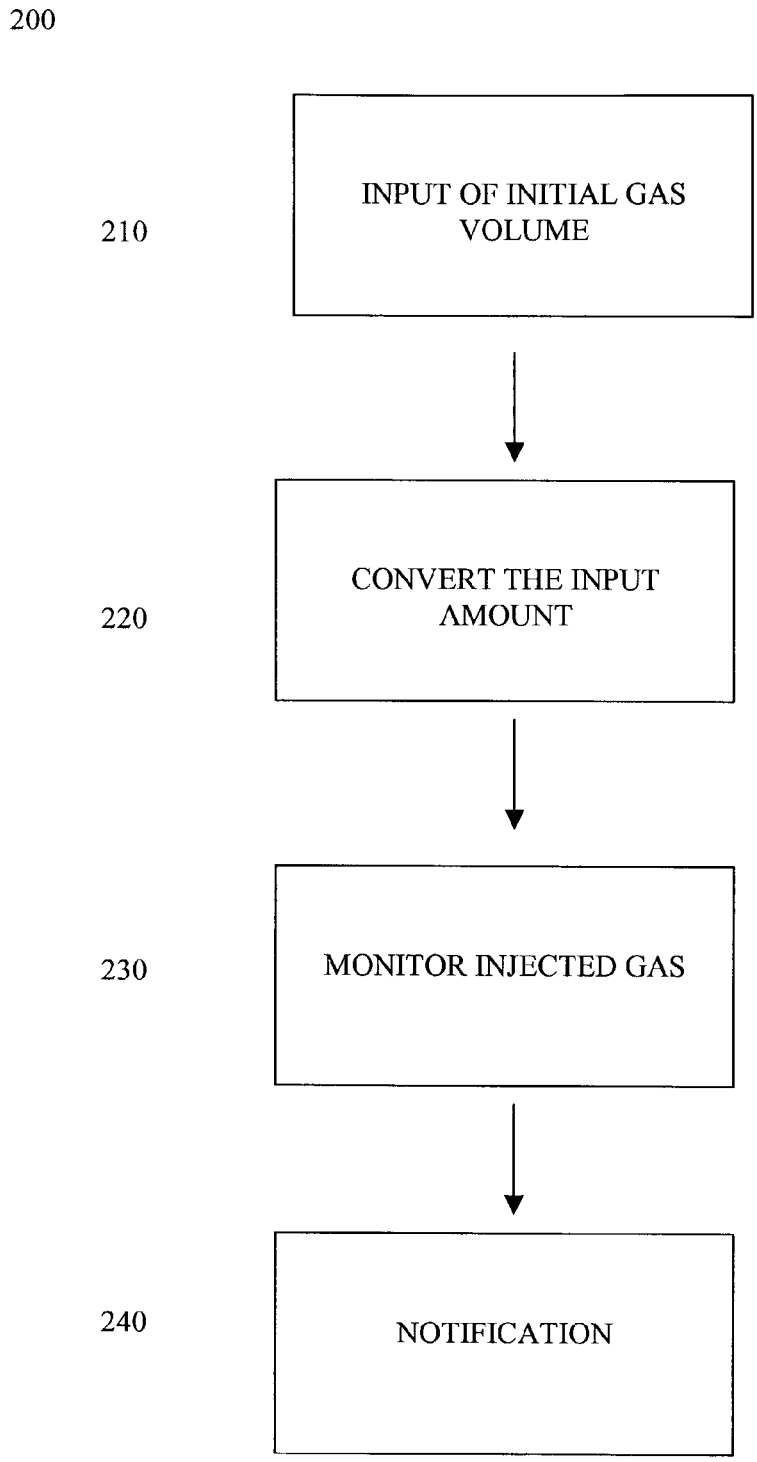
FIG. 2 is a flowchart of an embodiment of the present invention.

FIG. 2 is a flowchart 200 of an embodiment of the present invention. The flow chart 200 starts at step 210, where a user can be prompted to input the initial volume of gas in the gas supply tank via the interface 105. The user can also input the initial volume of gas without being prompted or no input is required if the initial volume of the tank is preset or known to the notification system 100. The gas may be $O_2$, $CO_2$, $N_2$ or any gas that is desired. Typically, the initial volume is measured in cubic feet but could be measured in any volume unit. At step 220, the volume unit entered at step 210 can be converted by the gas volume converter 115 to another volume unit, as required by the user. For example, the converter 115 can convert cubic feet to liters or any other volume unit desired by the user. The converter 115 can contain all the required conversion units to convert from one volume unit to another. Examples of volume unit can include, but not limited to cubic feet, cubic meter, cubic centimeter, cubic inch, cubic yard, milliliter, deciliter, liter, ounce, pint, quart, and gallon. Step 220 is not needed if the user is satisfied with the volume unit used with the gas supply tank or the same volume unit is used every time. At step 230, a monitoring device such as a transducer can be used to monitor the rate of gas being injected into the incubator over a period of time. The user can set the predetermined level for notification via the interface 105 so that when the transducer determines that the amount of injected gas has reached the predetermined level, it can communicate with the indicator 120 to notify the user at step 240. At step 240, the indicator 120 can notify the user that the predetermined level has been reached and the gas supply tank will be empty soon. The user can take appropriate action such as changing the tank, manually switching to another tank, or other actions that the user deems appropriate.

A person skilled in the art will recognize that the invention can be useful in a one supply tank incubator (one primary for each gas used by the incubator), in a primary and second gas supply tank incubator and in other incubators that utilize combinations of gas supply tanks. The initial volume of each gas supply tank that is utilized by the incubator should be known in order to determine how much gas has been injected by each gas supply tank. Even if the secondary gas supply tank is used intermittently (primary gas tank is replaced shortly after secondary gas tank utilized), the embodiments of the invention can monitor and indicate when the secondary gas supply tank is near empty.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A notification apparatus for an incubator, comprising:

a gas monitor that determines the amount of gas remaining in a gas supply tank by determining the amount of gas from the gas supply tank that has been injected into the incubator, the gas monitor is configured to generate a notification condition upon the amount of gas in the gas supply tank reaching a predetermined level; and an indicator linked to the gas monitor, the indicator is configured to indicate the notification condition.

2. The notification of apparatus of claim 1 further comprising:

an interface for inputting information; and a gas volume converter that converts from one gas volume unit to another gas volume unit, wherein the gas monitor, the indicator, the interface and the gas volume converter are in communication with each other.

3. The notification apparatus of claim 2, wherein a user inputs the initial volume of the gas supply tank via the interface.

4. The notification apparatus of claim 2, wherein a user inputs the predetermined level of gas that the user will be notified by the indicator.

5. The notification apparatus of claim 2, wherein the gas volume unit can be selected from a group consisting of cubic feet, cubic meter, cubic centimeter, cubic inch, cubic yard, milliliter, deciliter, liter, ounce, pint, quart, and gallon.

6. The notification apparatus of claim 1, wherein the gas monitor is a transducer.

7. The notification apparatus of claim 1, wherein the indicator notifies visually.

8. The notification apparatus of claim 1, wherein the indicator notifies audibly.

9. The notification apparatus of claim 1, wherein the indicator notifies tactilely.

10. A method of notifying a user of low gas supply tank volume, comprising:

inputting an initial volume of gas of a gas supply tank;

determining the amount of gas remaining in the gas supply tank by determining the amount of gas from the gas supply tank that has been injected into an incubator; and notifying the user when the gas supply tank reaches a predetermined level.

11. The notifying method of claim 10, wherein inputting the initial volume is done via a user interface.

12. The notifying method of claim 10 further comprises inputting the predetermined level of gas that the user would be notified when the gas supply tank reaches said level.

13. The notifying method of claim 10, wherein a transducer is used to monitor and relay to an indicator when the predetermined level has been reached.

14. The notifying method of claim 10, wherein notifying the user can be notified via visually, audibly, tactilely, or a combination thereof.

15. A notification system for an enclosed incubator comprising:

means for determining the amount of gas remaining in a gas supply tank by determining the amount of gas from the gas supply tank that has been injected into the incubator, the means for determining is configured to generate a notification condition upon the amount of gas in the gas supply tank reaching a redetermined level; and means for indicating linked to the means for determining, the means for indicating is configured to indicate the notification condition.

16. The notification system of claim 15 further comprising:

means for inputting information; and means for converting from a gas volume unit to another gas volume unit.

17. The notification system of claim 16, wherein the means for inputting information is a user interface.

18. The notification system of claim 15, wherein the gas in the gas supply tank is selected from a group consisting of $CO_2$, $O_2$, and $N_2$.

19. The notification system of claim 15, wherein the means for determining is a transducer means.

20. The notification system of claim 15, wherein the means for indicating notifies the user visually, audibly, tactilely, or a combination thereof.

* * * * *